US005107392A

United States Patent [19]

Söhner et al.

[11] Patent Number: 5,107,392

[45] Date of Patent: Apr. 21, 1992

[54] FINAL IGNITION STAGE OF A TRANSISTORIZED IGNITION SYSTEM

[75] Inventors: Gerhard Söhner, Geradstetten; Ulrich Bentel, Wiernsheim-Iptingen, both of Fed. Rep. of Germany

[73] Assignee: Robert Bosch GmbH, Stuttgart, Fed. Rep. of Germany

[21] Appl. No.: 671,894

[22] PCT Filed: Aug. 5, 1989

[86] PCT No.: PCT/DE89/00516

§ 371 Date: Mar. 8, 1991

§ 102(e) Date: Mar. 8, 1991

[87] PCT Pub. No.: WO90/05848

PCT Pub. Date: May 31, 1990

[30] Foreign Application Priority Data

Nov. 18, 1988 [DE] Fed. Rep. of Germany ..... 3839039

[51] Int. Cl.[5] ..... F23Q 3/00

[52] U.S. Cl. ..... 361/253; 123/623

[58] Field of Search ..... 361/253, 254, 255; 123/623, 644

[56] References Cited

U.S. PATENT DOCUMENTS 4,084,567 4/1978 Hachiga ..... 123/623

FOREIGN PATENT DOCUMENTS

89/03937 5/1989 European Pat. Off. .
2609677 9/1976 Fed. Rep. of Germany .
2619859 3/1989 France .

*Primary Examiner*—Donald A. Griffin
*Attorney, Agent, or Firm*—Michael J. Striker

[57] ABSTRACT

The invention relates to a final ignition stage of a transistorized ignition system (1) having a Darlington transistor (DT), in the collector-emitter circuit of which the primary coil current ($I_{SP}$) of an ignition coil (ZS) flows and which is controlled via a base line (2). According to the invention, there is a regulating transistor ($T_1$) arranged between the base line (2) to the base of the Darlington transistor (DT) and earth, said regulating transistor being driven in correspondence with the size of the primary coil current ($I_{SP}$) and for purposes of current limitation partially conducting away to earth the base current flowing into the Darlington transistor (DT). Thus, a simple, cost-effective circuit for limiting the primary coil current and thus the stored ignition power is obtained.

6 Claims, 5 Drawing Sheets

FINAL IGNITION STAGE OF A TRANSISTORIZED IGNITION SYSTEM

STATE OF THE ART

Figure 1:
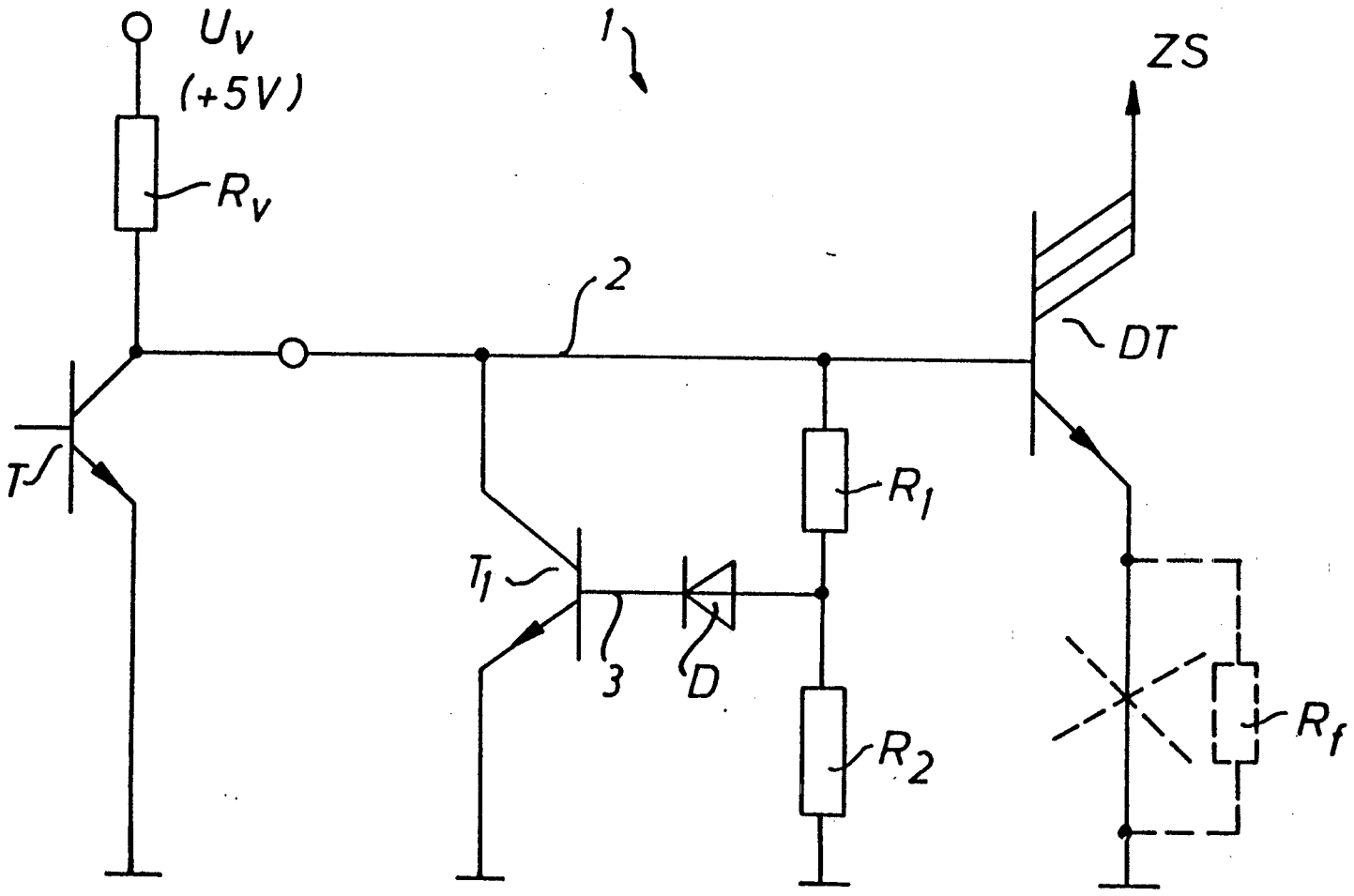

The invention relates to a final ignition stage of a transistorized ignition system (TI system) according to the preamble of claim 1.

It is known to control final ignition stages of transistorized ignition systems with a Darlington transistor, in the collector-emitter circuit of which the primary coil current of the ignition coil flows. For necessary limitation of the primary coil current and thus simultaneous limitation of the stored ignition power, the use of an active current regulator is known which is contained in an integrated circuit and installed in hybrid association. Such an integrated active current regulator is relatively costly and expensive.

ADVANTAGES OF THE INVENTION

In a final ignition stage of a transistorized ignition system with the features of claim 1, the integrated active current regulator can be omitted. The function of this current regulator is essentially replaced by the use of a simple control transistor without additional voltage supply. This transistor enters the active range on commencement of the current limitation and partially conducts away to earth the base current flowing into the Darlington transistor. The circuit thus serves to limit the primary coil current and can be used both as a simple current limiter and as a short circuit protection. The subclaims contain advantageous further developments of the subject according to the main claim. In particular, concrete circuits are required with which the driving of the control transistor is improved and the influence of drive voltage tolerances is reduced.

DRAWINGS

Figure 2:
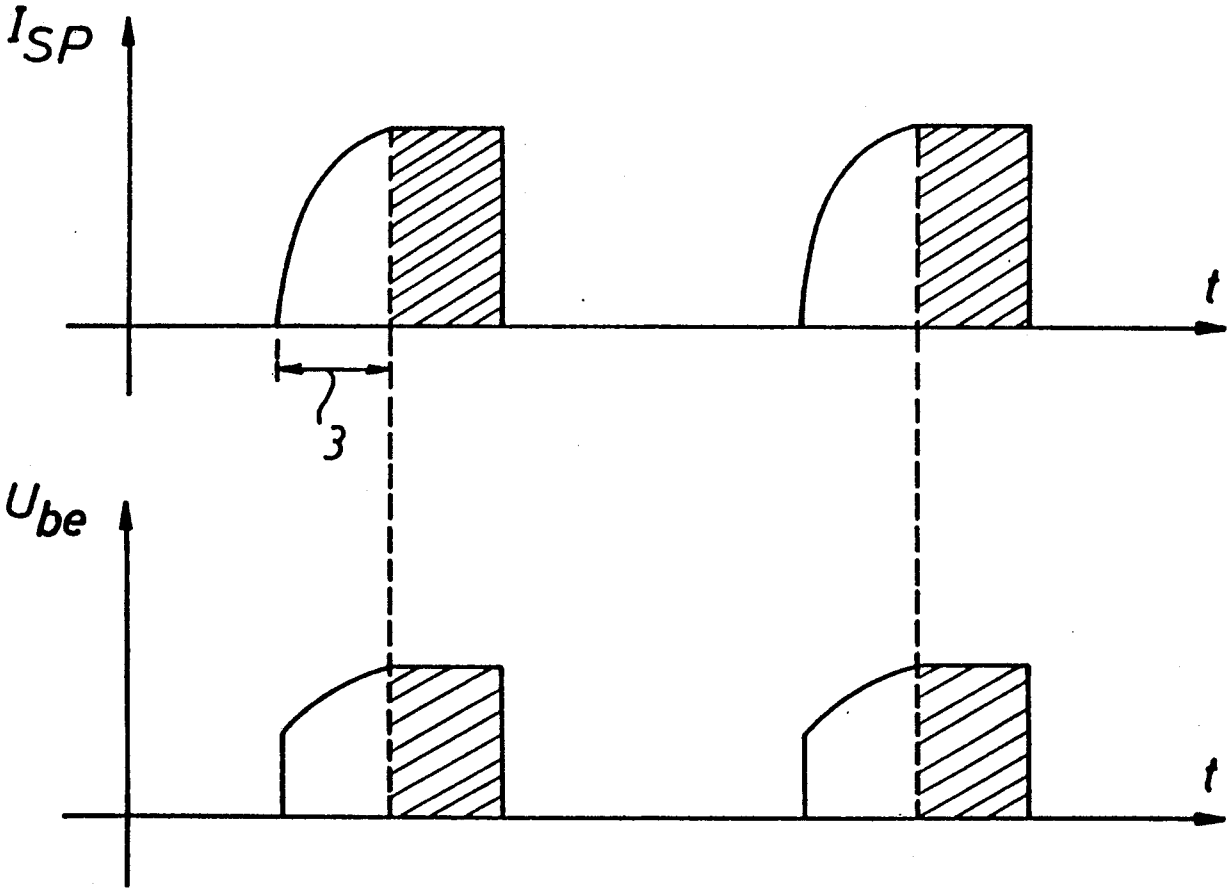
Figure 3:
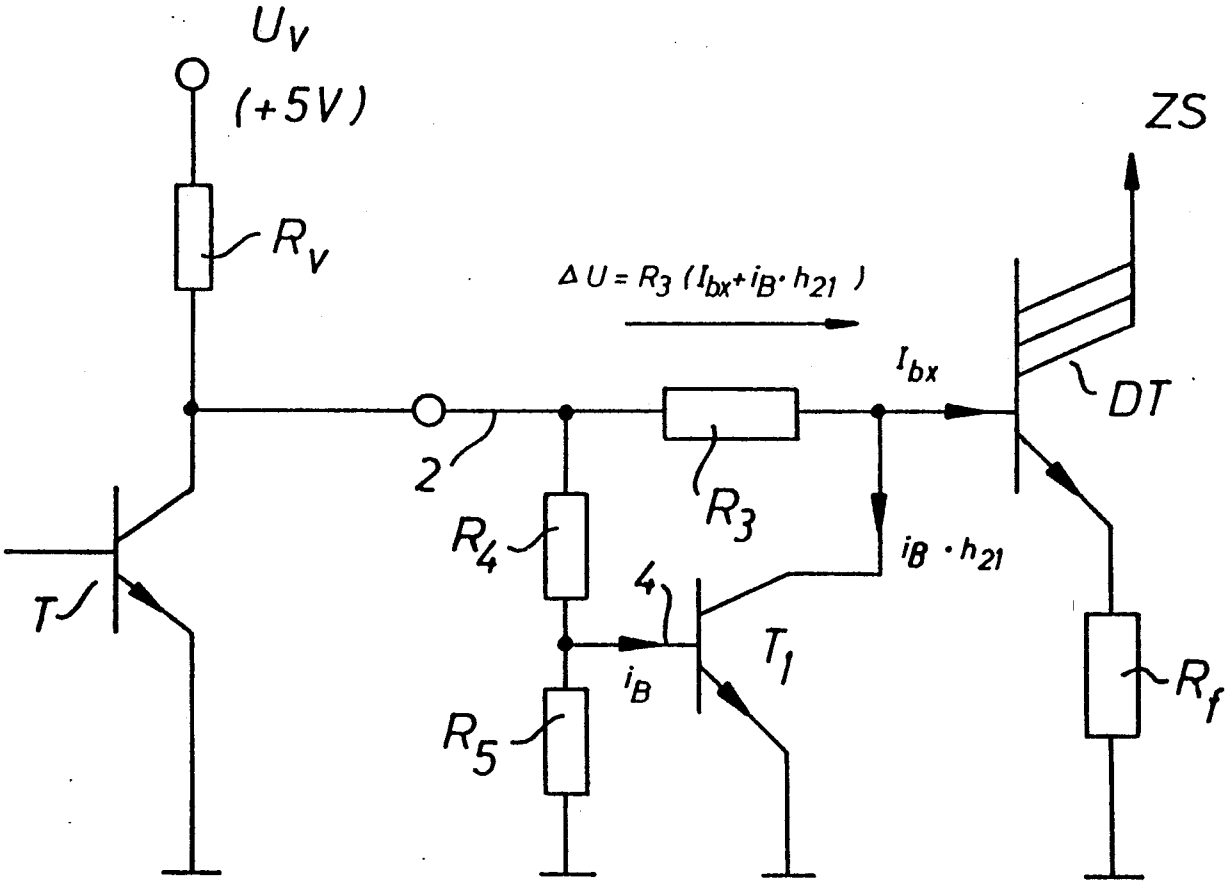
Figure 4:
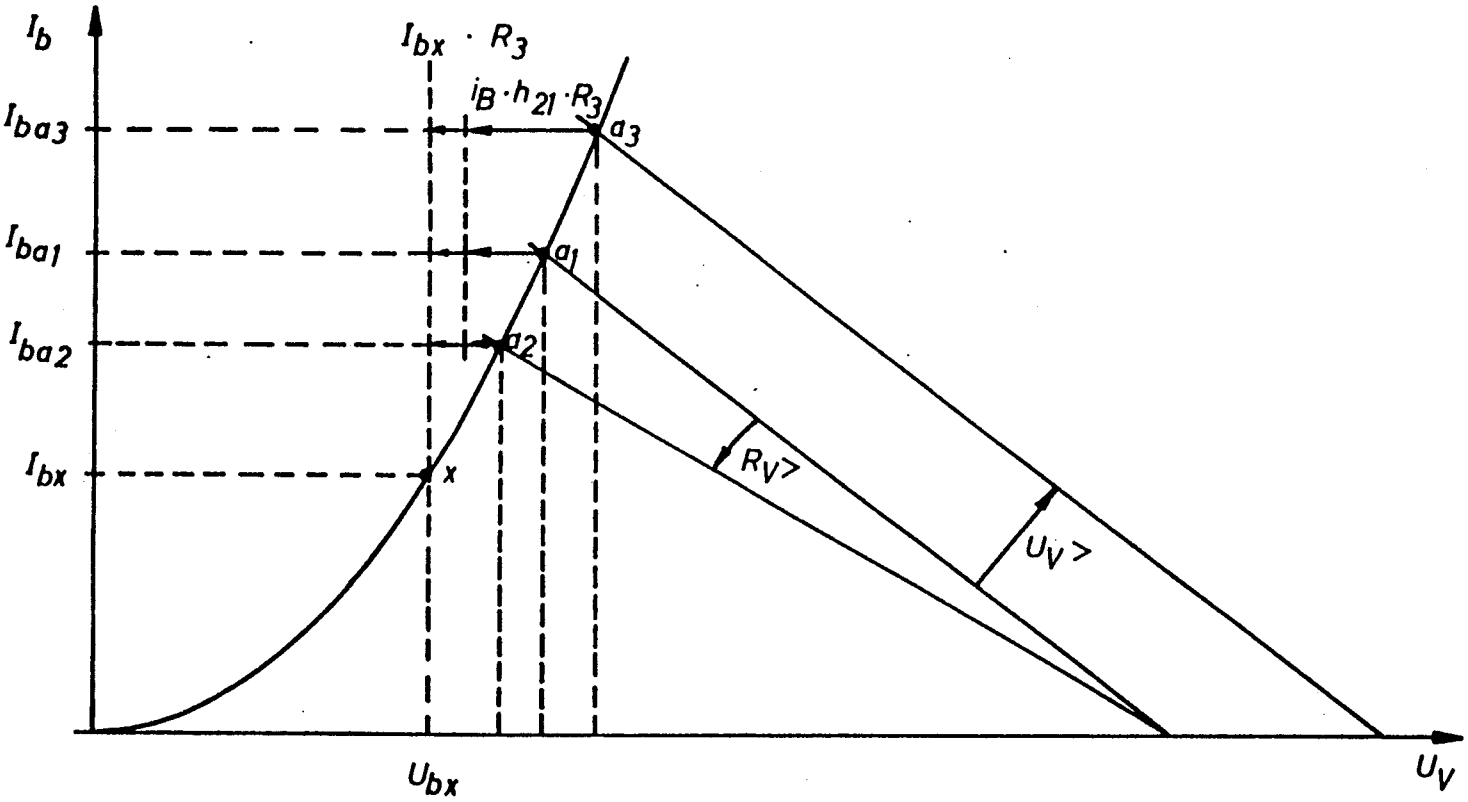
Figure 5:
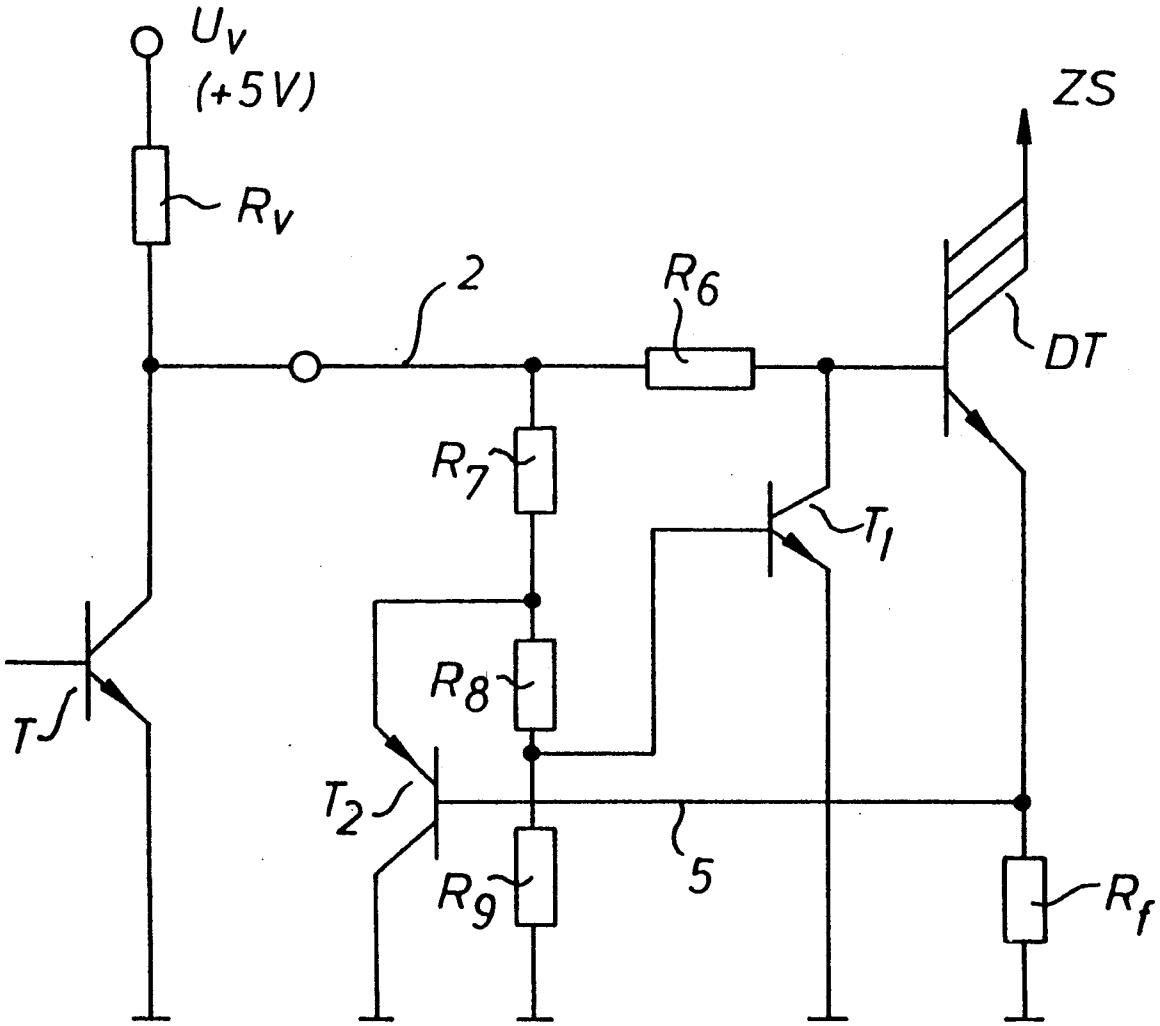

Exemplary embodiments of the invention are represented in the drawings and described in greater detail in the subsequent description, wherein:

FIG. 1 shows the circuit of a first exemplary embodiment of the invention,

FIG. 2 is a time-dependency diagram concerning the commencement of the current limitation and showing the characteristic of the primary coil current and the base-emitter voltage, FIG. 3 shows the circuit of a second exemplary embodiment of the invention, FIG. 4 is a characteristic line diagram which shows the improvement, in respect of the first exemplary embodiment, which is achieved with the second exemplary embodiment, FIG. 5 shows a circuit of a third exemplary embodiment.

In the circuit according to FIG. 1, the primary coil current for an ignition coil ZS of a transistorized ignition system 1, which is known per se and not further represented, flows in the collector-emitter circuit of a Darlington transistor DT. The Darlington transistor DT is driven via its base and a base line 1 according to the switching state of a transistor T. The driving occurs with the aid of a drive voltage $U_v$ and a series resistor $R_v$.

Between the base line 2 to the Darlington transistor DT and earth there is a control transistor T with its collector-emitter circuit. Between the base line 2 and earth there is also a divider circuit consisting of resistors $R_1$ and $R_2$. From the centre tap of this divider circuit a line 3 leads to the base of the control transistor $T_1$, a diode D being arranged in the line 3.

The circuit according to FIG. 1 has the following function: the base voltage present at the Darlington transistor DT is an indirect reproduction of the current flowing in the collector-emitter circuit. Controlling this base voltage by the control transistor $T_1$ thus permits an indirect control of the collector current or of the primary coil current $I_{SP}$.

The base-emitter voltage present at the base of the Darlington transistor in the switched-on state is divided by the divider resistors $R_1$, $R_2$ to the level of two diode forward voltages The regulating transistor $T_1$ is driven with this voltage. The regulating transistor $T_1$ conducts away to earth a part of the base current for the Darlington transistor. In this way, the Darlington transistor is operated in the active range and the primary coil current $I_{SP}$ is controlled. The collector current or primary coil current is a function of the base-emitter voltage. Thus, limitation of the primary coil current and simultaneous time limitation of the stored ignition power is achieved. The circuit serves both as a simple current limiter and as a short circuit protection.

The mode of operation of this simple regulation is improved by the addition of a current sensor resistor $R_f$ into the emitter line of the Darlington transistor DT. As a result of this, the detected base voltage is the sum of the base-emitter voltage of the Darlington transistor DT and of the voltage, which is proportional to the collector current, at the sensor resistor $R_f$. However, there is no direct effect of the sensor resistor on the regulating transistor $T_1$ (in contrast with the third exemplary embodiment).

In the upper part of FIG. 2, there is a time-dependency diagram for the characteristic of the primary coil current and in the lower part there is one for the characteristic of the base-emitter voltage of the Darlington transistor DT. The rise times (arrow 3) are approximately three to five ms. In the region defined by broken lines, the current limitation has already become active through the regulating transistor $T_1$ entering the active region and partially conducting away to earth the base current flowing into the Darlington transistor DT.

In FIG. 3, the circuit of a second exemplary embodiment of the invention is represented. Here too, a Darlington transistor DT is used, in the emitter line of which there is a current sensor resistor $R_f$ and in the collector-emitter circuit of which there is an ignition coil ZS. The driving of the Darlington transistor DT occurs likewise via a base line 2 corresponding to the switching state of a control transistor T. Arranged between the base line 2 and earth there is also a divider circuit consisting of resistors $R_4$ and $R_5$ as well as the regulating transistor $T_1$. The base of the regulating transistor $T_1$ is connected via a line 4 to the centre tap of the divider circuit. To this extent, this circuit according to FIG. 2 essentially corresponds to the circuit according to FIG. 1.

However, in addition there is here a resistor $R_3$ mounted in the base line 2 between the branches to the regulating transistor $T_1$ and the divider circuit consisting of the resistors $R_4$ and $R_5$.

The function of this second exemplary embodiment is explained in greater detail in conjunction with the diagram according to FIG. 4: here, the influencing of the collector current limitation of the Darlington transistor DT by the drive voltage tolerances of $U_v$ and resistance tolerances of $R_v$ is reduced by the insertion of the resistor $R_3$, which is achieved by correspondingly dimensioning the current amplification of the regulating transistor $T_1$ and of the resistor $R_3$. The mode of operation of the circuit can be seen from the characteristic lines in FIG. 4. The operating point of the Darlington transistor in the circuit of the second exemplary embodiment is defined by x and, for the sake of clarity, displaced in the direction of a smaller $U_{bx}$. Offset in relation to this, there are the operating points which are obtained with the first circuit (FIG. 1) depending on the drive voltage tolerance and series resistance tolerance ($U_v$ and $R_v$) and are indicated by $a_1$ to $a_3$. It can be seen from the illustration in FIG. 4 that the influence exerted on the collector current limitation by the addition of the resistor $R_3$ declines.

In FIG. 5, the circuit of a third exemplary embodiment of the invention is represented. Here too, a Darlington transistor DT is contained in the circuit of the ignition coil ZS and a current sensor resistor $R_f$ is located in its emitter line. Driving of the Darlington transistor DT occurs here too via the base line 2 corresponding responding to the previous circuit, a resistor $R_s$ being located in the base line 2 between the branch of the regulating transistor $T_1$ and the branch of the divider circuit ($R_7$, $R_8$ and $R_9$), said resistor corresponding to the resistor $R_3$ from the circuit according to FIG. 3. The regulating transistor $T_1$ here too lies between the base line 2 and earth.

However, here the regulating transistor $T_1$ is driven in such a way that a line 5 leads from the emitter line of the Darlington transistor upstream of the current sensor resistor $R_f$ to the base of a second transistor $T_2$. The collector-emitter circuit of this second transistor $T_2$ is located between a divider circuit consisting of resistors $R_7$, $R_8$ and $R_9$ and earth. This divider circuit consisting of the resistors $R_7$, $R_8$ and $R_9$ is likewise arranged between the base line 2 and earth. The base of the regulating transistor $T_1$ is driven via a branch out of the divider circuit ($R_7$, $R_8$ and $R_9$).

The circuit according to the third exemplary embodiment has the following function: the control voltage for the second transistor $T_2$ is equivalent to the primary coil current $I_{SP}$ at the sensor resistor $R_f$. The transistor $T_2$ transfers the displaced voltage via the current sensor resistor $R_f$ to the regulating transistor $T_1$ via the divider $R_8/R_9$. Thus, in this circuit there is a direct reaction of the primary coil current $I_{SP}$ via the current sensor resistor $R_f$ and the transistor $T_2$ on the regulating transistor $T_1$. The advantage of this circuit is that the sensor resistor $R_f$ can be dimensioned to have very low impedance which favours a low collector-earth saturation voltage of the Darlington transistor DT because the control voltage for the transistor $T_2$ can be smaller than a base-emitter threshold.

We claim:

1. Final ignition stage of a transistorized ignition system (TI system) having a Darlington transistor (DT), in the collector-emitter circuit of which the primary coil current ($I_{SP}$) of an ignition coil (ZS) flows and which is controlled via a base line (2) leading to its base, and having a device for limiting the primary coil current ($I_{SP}$), characterized in that the device for limiting the primary coil current ($I_{SP}$) consists of a regulating element ($T_1$) arranged between the base line (2) to the base of the Darlington transistor (DT) and earth, said regulating element being driven in correspondence with the size of the primary coil current ($I_{SP}$) and which enters the active range on the commencement of the current limitation for the primary coil current ($I_{SP}$) and thereby partially conducts away to earth the base current ($I_b$) flowing into the Darlington transistor (DT) via the base line.

2. Final ignition stage according to claim 1, characterized in that the regulating transistor ($T_1$) is located with its collector-emitter circuit between the base line (2) and earth, and in that its base is driven via the centre tap of a divider circuit consisting of resistors ($R_1$ and $R_2$) between the base line (2) and earth and a diode (D) arranged between the centre tap and the base.

3. Final ignition stage according to claim 2, characterized in that a current sensor resistor ($R_f$) is arranged in the emitter line of the Darlington transistor (DT).

4. Final ignition stage according to claim 1, characterized in that the regulating transistor ($T_1$) is located with its collector-emitter circuit between the base line (2) and earth, in that a divider circuit consisting of resistors ($R_4$ and $R_5$) is located in parallel to the latter likewise between the base line (2) and earth, however further upstream of the regulating transistor ($T_1$) or of the Darlington transistor (DT) in that the base of the regulating transistor ($T_1$) is driven via the centre tap of the divider circuit ($R_4$ and $R_5$) and in that, between the branch of the regulating transistor ($T_1$) and of the divider circuit ($R_4$ and $R_5$) in the base line (2), a resistor ($R_3$) is arranged for reducing the influence on the control or reducing the influence on the limitation of the primary coil current ($I_{SP}$) by means of drive tolerances ($U_v$) and series resistance tolerances ($R_v$).

5. Final ignition stage according to claim 4, characterized in that a current sensor resistor ($R_f$) is arranged in the emitter line of the Darlington transistor (DT).

6. Final ignition stage according to claim 1, characterized in that a current sensor resistor ($R_f$) is arranged in the emitter line of the Darlington transistor (DT), in that, upstream of the current sensor resistor ($R_f$), a (5) line leads to the base of a second transistor ($T_2$), the control voltage applied here being equivalent to the primary coil current ($I_{SP}$) at the sensor resistor ($R_f$), in that the collector-emitter circuit of the second transistor ($T_2$) is located between a divider circuit consisting of resistors ($R_7$, $R_8$ and $R_9$) and earth, the divider circuit ($R_7$, $R_8$ and $R_9$) is arranged between the base line (2) and earth and in that the regulating transistor ($T_1$) is located nearer to the Darlington transistor (DT) and with its collector-emitter circuit likewise between the base line (2) and earth, its base being driven via a branch out of the divider circuit ($R_7$, $R_8$ and $R_9$) and a resistor ($R_6$) being arranged between the regulating transistor ($T_1$) and the divider circuit ($R_7$, $R_8$ and $R_9$) in the base line (2).

* * * * *